United States Patent [19]

Kahlman

[11] Patent Number: 4,515,321

[45] Date of Patent: May 7, 1985

[54] METHOD TO CUT OFF A PREFERABLY BAND SHAPED RUNNING WEB OF TEARABLE MATERIAL AND MEANS TO CARRY OUT THE METHOD

[76] Inventor: Sture Kahlman, Strandvägen 22, 666 00 Bengtsfors, Sweden

[21] Appl. No.: 475,480

[22] Filed: Mar. 15, 1983

[30] Foreign Application Priority Data

Mar. 15, 1982 [SE] Sweden ..... 8201606

[51] Int. Cl.[3] ..... B65H 19/20; B65H 35/10; B26D 1/12; B26F 3/02

[52] U.S. Cl. ..... 242/56 R; 225/4; 225/100; 225/106

[58] Field of Search ..... 242/56 R, 56 A, 56.6; 225/4, 100, 106, 98

[56] References Cited

U.S. PATENT DOCUMENTS

| | | | |
|---|---|---|---|
| 3,137,456 | 6/1964 | Weber et al. | 242/56 R |
| 3,857,524 | 12/1974 | Melead et al. | 242/56 R |
| 3,871,595 | 3/1975 | Smolderen | 242/56 A |
| 3,889,892 | 6/1975 | Melead | 242/56 R |
| 3,991,924 | 11/1976 | Schueler | 225/100 |
| 4,058,267 | 11/1977 | Schüttler | 242/56 A |
| 4,146,187 | 3/1979 | Steiner et al. | 242/56 R |
| 4,397,410 | 8/1983 | Schueler | 225/100 X |

*Primary Examiner*—Frank T. Yost

[57] ABSTRACT

Method and device to cut-off a running web of tearable material and to feed an end of the web to a reel around which the web is to be wound and supported respectively. The web of material is at the center portion of the web perforated by means of a cutting apparatus provided with a point. The cutting apparatus is moved at a speed which is lower than the speed of the feed of the web material, so that the web of material during its continued forward feed is torn apart from the area of the perforation in a direction to the two respective lateral edges of the web of material. The free end of the web of material thus being cut-off is guided by the cutting apparatus, so that it is introduced between the reel and the portion of the web of material which runs to the reel.

9 Claims, 12 Drawing Figures

METHOD TO CUT OFF A PREFERABLY BAND SHAPED RUNNING WEB OF TEARABLE MATERIAL AND MEANS TO CARRY OUT THE METHOD

The present invention relates to a method to cut off a preferably band shaped running web of a tearable material and to feed an end of a web of material to a cylinder designed to support the web and round which cylinder the web is wound.

In order to cut off a running web of material and to feed an end of such a web to a reel round which the web shall be wound and on which it shall be supported at the same time as it is running, so that delaying interruptions of the operation are avoided, a great variety of solutions have been brought forward in the prior art. However, said solutions have turned out to be complicated and have not either permitted an adaptation to already existing winding machines in an effective manner, so that the latter ones could obtain a certain degree of automatic function.

It is a principal object of the present invention in the first place to provide a method of the kind mentioned, that solves the problems in question.

Said object is obtained by means of a method according to the present invention, which is substantially characterized by a cutting apparatus equipped with a point perforating the web of material at a certain distance from the respective two lateral edges of the web, this preferably taking place at the centre portion of the web, said cutting apparatus in relation to said web performing a movement at a speed, which is lower than the speed of the forward feed of the web, so that the same is torn apart during its continued forward feed from the area of said perforation in direction towards said two edges of the web, and by the free end of the web of material thus cut-off being guided by said cutting apparatus, so that it is introduced between the reel and the portion of the material web, which is running to the reel.

It is another object of the invention to provide a means that makes possible to carry out the method according to the invention.

Said additional object is obtained by means of an arrangement which is substantially characterized by a cutting off means equipped with a point being movably supported in relation to the material web and arranged to move at a speed, which is lower than the feeding speed of the web of material, and moreover being arranged to guide an end of the web of material, so that it is introduced in the pocket formed between the reel and the portion of the web of material running in the direction to the reel.

Figure 1:
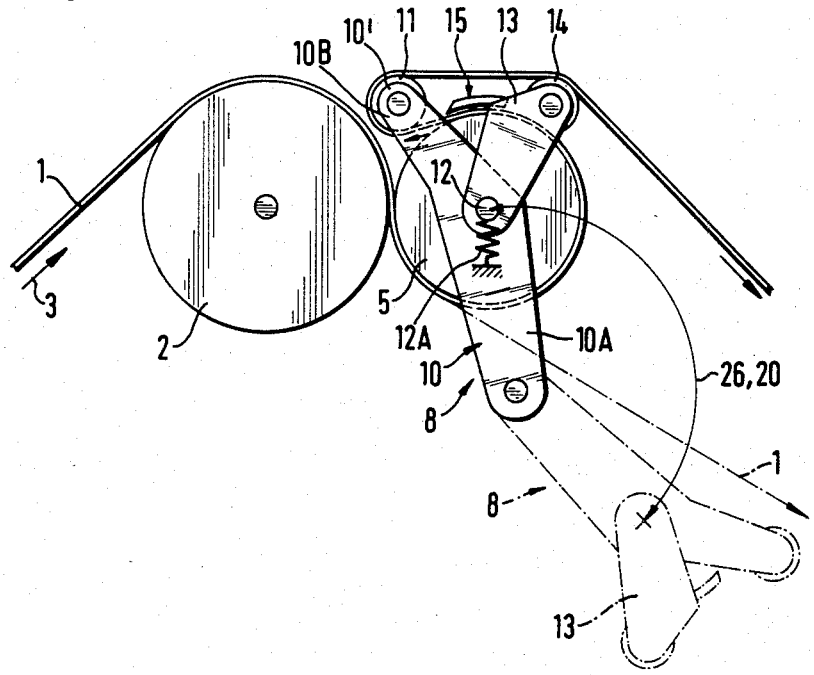
Figure 1A:
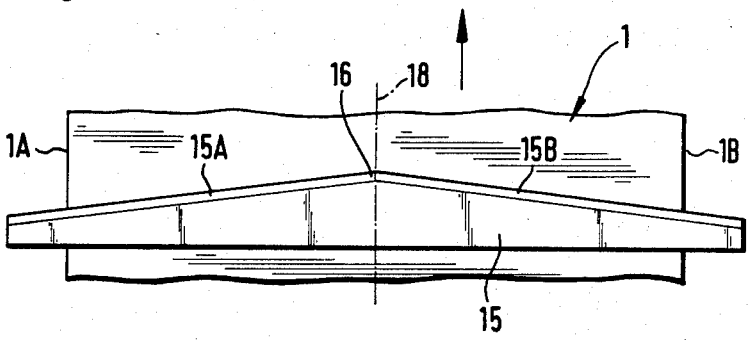
Figure 2:
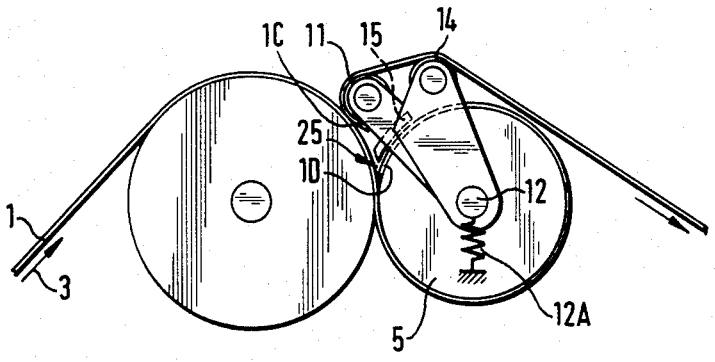
Figure 2A:
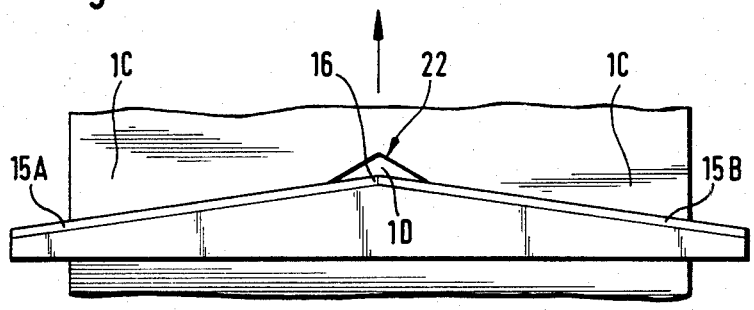
Figure 3:
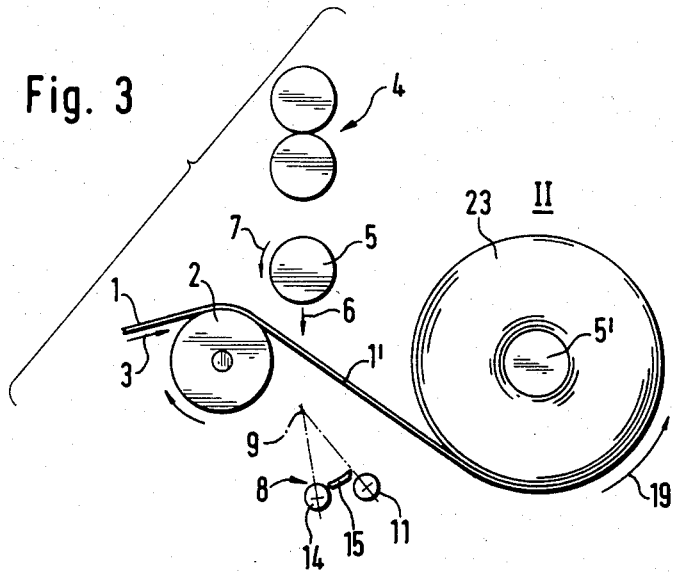
Figure 4:
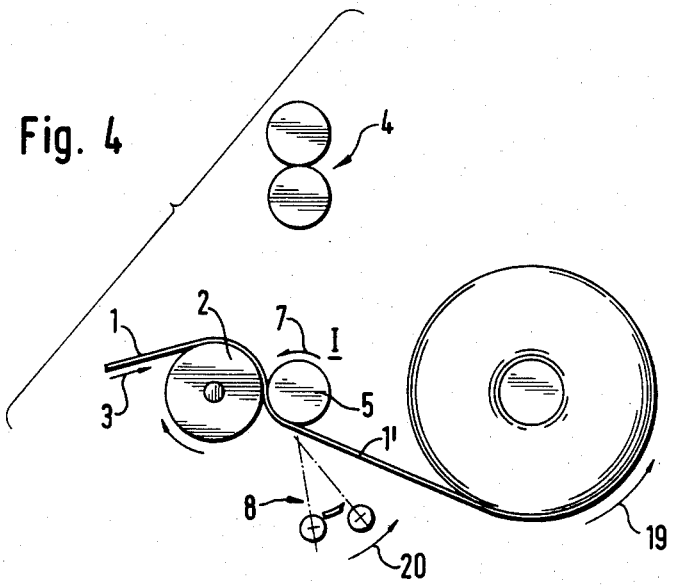
Figure 5:
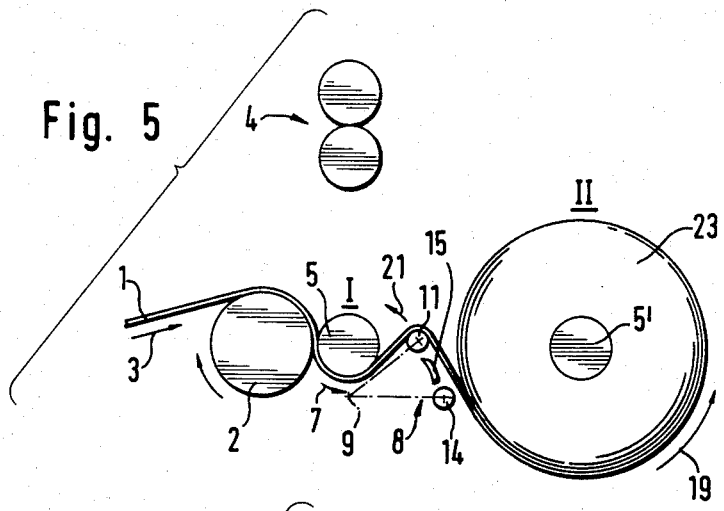
Figure 6:
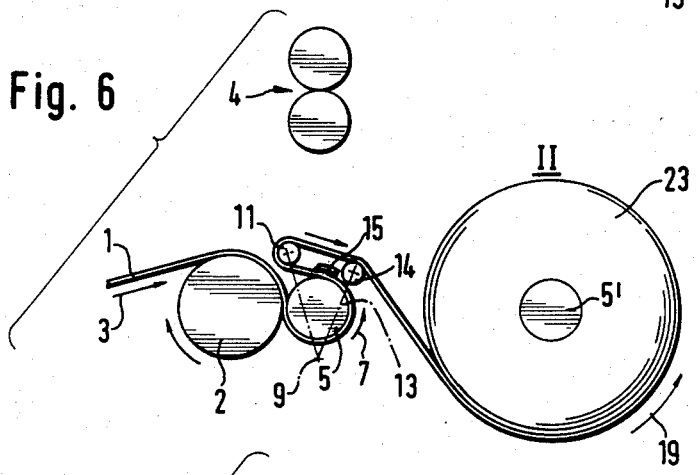
Figure 7:
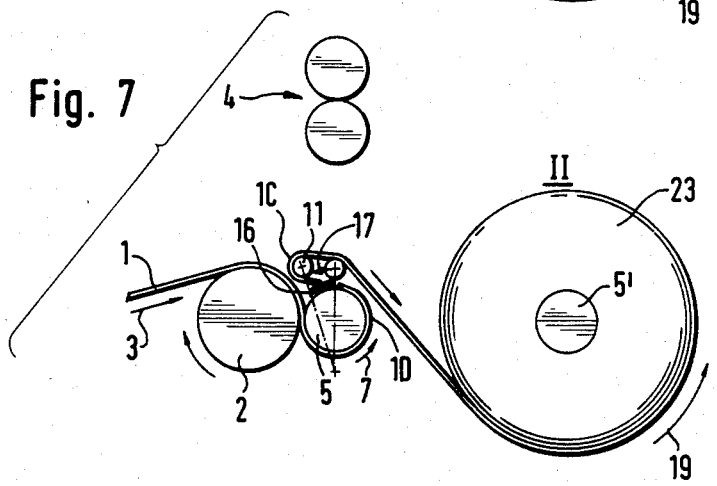
Figure 8:
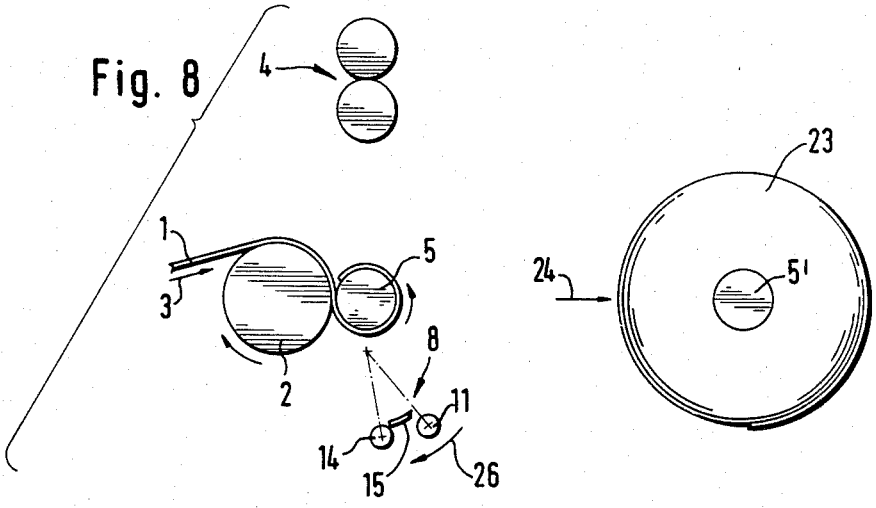
Figure 9:
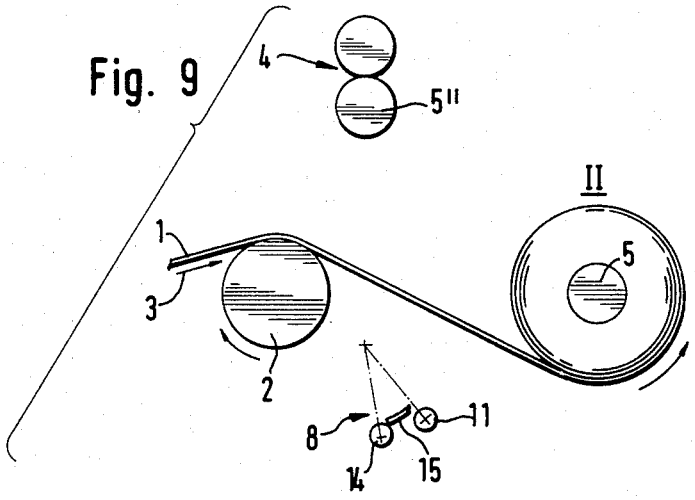
Figure 10:
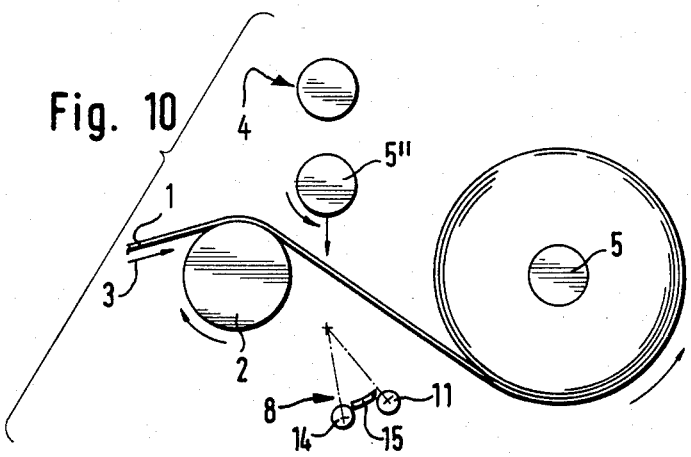

The invention is described in the following by means of an example of embodiment of the same, reference being made to the accompanying drawings, in which:

FIG. 1 is a view of an arrangement according to the invention as seen in side elevation and kept in a position, in which it is ready to cut, a rest position being indicated with broken lines, FIG. 1A is a top view of a cutting apparatus forming part of the arrangement and held in a position, in which it is ready to cut, FIG. 2 is a view of the arrangement with the cutting-off apparatus moved into a cutting position, FIG. 2A is a view of the cutting-off apparatus and the web of material during a cutting-off operation, as seen from above, FIGS. 3–10 schematically illustrate different operationg sequences of the arrangement during the cutting-off operation of the web of material, as well as the guiding and the winding up of the same, of which FIG. 3 illustrates how an empty storage reel is placed in position close to the web of material in front of an almost fully loaded reel, FIG. 4 illustrates the empty reel being brought to the position, in which it is ready to receive an end portion of the web, FIG. 5 illustrates the arrangement in an initial stage of a winding up operation of the web of material round the empty reel, FIG. 6 illustrates the arrangement brought into the position, in which it is ready to cut, and corresponding to the position illustrated in FIG. 1, FIG. 7 illustrates the arrangement in its cutting-off position corresponding to the position illustrated in FIG. 2, FIG. 8 illustrates the cutting-off apparatus moved into its rest position, and how the removal of a reel loaded with material web takes place, FIG. 9 illustrates a partly loaded reel moved into a position for a continuation of the winding-up operation, and FIG. 10 illustrates how a new empty reel is again placed in position close to the web of material.

In the drawings a web of material, which by way of example can comprise a band-shaped paper web fed from a paper making machine, which is not shown on the drawing, is indicated with the digit 1. The web 1 is led over a cylinder 2, which is driven by a motor and designed to convey the web 1 in its direction of feed indicated by the arrow 3. A hopper 4 for the reception of empty reels 5, round which the web 1 shall be wound up, and on which it shall be supported, is by way of example provided in the space above the web portion 1' extending from the driving cylinder 2. The empty reels 5 are arranged one by one at a proper moment to be brought in the direction of the arrow 6, as is shown in FIG. 3, at the same time as the reel 5 is suitably brought to rotate in the direction of the arrow 7 in the direction of the web to its position I close to the web 1 and the conveying cylinder 2, as is shown in FIG. 4, which position I is its initial position of readiness to receive the web. The web 1 of material extends from the conveying cylinder 2 to an additional reel 5', which is rotatably supported at a certain distance from said empty reel 5 at a winding-up station II, where the web 1 of material is wound up on the reel 5' in a desired degree.

A cutting-off apparatus, which in the drawings is indicated with the digit 8, can be actuated by means of for example fluid operated pistons, preferably pneumatically operated pistons, preferably being pivoted on a shaft 9 located on the opposite side of the portion 1 of the web of material, as seen in relation to the empty reel 5 and its position I. The cutting-off apparatus 8 is formed by a pivoting arm 10, comprising a number of arm elements located on each side of the two lateral edges 1A and 1B respectively of the web of the material, said arm elements for example being connected with each other via the pivoting shaft 9 and via deviating means 11 positioned in the space close to the two free outer ends 10' of the arms of the arm elements. Said deviating means 11 suitably comprises a rotatably supported roller 11 extending across the web 1 of material and along the same.

A pivoting link 12 is suitably supported by said pivoting arm 10 at a distance from the pivoting shaft 9 of the arm, that is chosen in such a manner that the distance suitably coincides with the distance between the pivoting shaft 9 and the centre area of an empty reel 5, which occupies a position at its position I of readiness for the reception of the web, preferably in the area of passage between a straight and an angular portion 10A and 10B respectively of the pivoting arm 10.

The pivoting link 12 comprises a shaft 12 connected with the respective arm element, suitably via a spring device 12A, said shaft 12 supporting a supporting arm 13 pivoted around said shaft 12, which arm 13 preferably also can be formed by two arm elements located one on each side of the two lateral edges 1A, 1B of the web of the material, said arm elements being connected with each other via a deviation means 14 extending along the web 1 and across the feeding direction of the same, said deviation means also suitably comprising a rotatably supported roller 14.

A preferably plough-like knife 15 provided with a point forms part of said cutting-off apparatus 8 and is suitably rigidly connected with said supporting arm 13, which is pivoted on the pivot shaft 12, said knife 15 having its point 16 facing in such a direction that it is brought towards the web 1 in the direction of the arrow 17 in counter-clockwise direction in the drawings. The point 16 is then suitably arranged to actuate along a plane, that extends through the centre line 18 of the web, and the two diverging front sides 15A and 15B respectively of the knife extend across the web 1 of the material outside of said two lateral edges 1A, 1B.

The function of the arrangement described above will now be explained, reference in the first place being made to the functional sequences shown in the drawings in FIGS. 3–10.

It is desired to exchange a fully loaded reel 5' rotating in the direction of the arrow 19 and substituting the same by an empty reel 5 for a continued winding-up of the web 1 of the material without the drive of the web 1 being interrupted or the need of a reduction of its transportation speed. This is performed by an empty reel 5 or other cylindric core, round which the web 1 can suitably be wound up, being fed out of the hopper 4 to the position I of the reel, where it is ready to receive the web, as is shown in FIGS. 3 and 4, and made to rotate in the direction of the arrow 7. The cutting-off apparatus 8 is subsequently pivoted in the direction of the arrow 20 against the portion 1' of the web, so that the roller 11 of the deviation means is brought to rotate as a consequence of its contact with the web 1, thereby winding up the web 1 round the reel 5 in the direction of the arrow 21 to the end position illustrated in FIG. 6. The supporting arm 13, with which the knife 15 is connected, is subsequently actuated by means of for example pneumatic power pistons, so that it pivots round the shaft 12 from the starting position shown in FIGS. 1 and 6 in the direction of the arrow 17 towards the roller 11 and the web 1 of the material, which web 1 in said position runs along the outer mantle surface of the reel 5 and is deviated round the deviating means 11. When the point 16 of the knife, which is moving at a lower speed than the one of the web 1, reaches contact with the web 1, preferably at its centre line 18, the web 1 is perforated in a perforation area 22. During the continued pivoting movement of the knife the material will be torn apart along the front sides 15A, 15B of the knife, as is schematically shown in FIG. 2A, from said area 22 towards the two lateral edges 1A, 1B of the web.

The rear end 10 of the web 1, which is thereby torn off as seen in its direction of feed, is thereafter free to leave the cutting-off apparatus 8 and to be fed out past the rollers 11, 14 to fit along the readywound-up reel 23 of the web of the material, which is removed in the direction of the arrows 24.

The free torn-off forward point portion 1D of the web of the material is guided by the knife 15, forming part of the cutting-off apparatus 8, between the reel 5 and the portion 1' of the web of the material, which runs to the reel 5, to a pocket 25, which is formed between the same. When the front end portion 1D of the web of the material has found a hold and the winding-up of the web 1 on the reel 5 has started, the cutting-off apparatus 8 is pivoted back to its rest position, which is indicated with broken lines in FIG. 1 in the direction of the arrow 26. The new reel 5 is subsequently displaced by means of suitable means, not shown in the drawings, to the position II, where the previous reel 23 was supported, and which is intended to be the site for the winding-up operation of the new reel.

The feeding-out operation of an additional new reel 5'' is finally shown in FIG. 10, said reel 5'' being intended to substitute the previously fed-out and the substantially fully loaded reel 5, by the web 1 again being cut off and in the continuation guided in the manner described above.

The invention is not limited to the embodiment described above and illustrated in the drawings by way of example only, but can be varied as to its details within the scope of the following claims.

I claim:

1. A method of cutting off a band-shaped running web of tearable material and feeding an end of the web of material to the reel around which the web of material shall be wound and on which it shall be supported respectively, comprising the steps of moving a reel into contact with said running web, deviating a portion of said running web which is out of contact with said reel around at least one deviation means at a predetermined distance from the reel whereby said web of material is wound around the reel, moving a cutting apparatus so that it can act upon a portion of the web of material which runs between the reel and said deviation means, said cutting apparatus having a point for perforating the web of material at the center portion of the web, moving said cutting apparatus towards said web of material in the direction of the movement of the web along the reel at a speed which is lower than the speed of the forward feed of the web to perforate said web, so that the web of material during its continued forward feed around the reel toward the deviation means is torn apart from the area of perforation of the material backwards against the movement of the web of material in a direction towards the respective two lateral edges of the web of material, and guiding a free end of the web of material thus cut-off by said cutting apparatus along the reel so that it is introduced between the reel and a portion of the web of material which runs to the reel.

2. Method according to claim 1, wherein said cutting apparatus is moved in a path along the mantle surface of the reel in a direction from one side of the reel during carrying of the web of material to and along the reel to an area which is located at the side of the reel which is opposed to said one side thereof.

3. Device for cutting off a band-shaped running web of tearable material and feeding an end of the web of material to a reel around which the web of material is to be wound and on which it shall be supported comprising means for moving a reel into contact with said running web, a cutting apparatus equipped with a point, means for movably supporting said cutting apparatus in relation to the web of material, and means for moving said cutting apparatus at a speed which is lower than the speed of the feed of the web of material towards said web of material to perforate said web with said point so that the web of material is torn apart from the area of perforation of the material backwards against the movement of the web of material in a direction towards the respective two lateral edges of the web of material, said cutting apparatus being arranged to guide a free cut-off end of the web of material so that it is introduced into a pocket which is formed between the reel and a portion of the web of material which runs to the reel.

4. Device according to claim 3, wherein the cutting apparatus comprises a plough-like knife provided with said point and movable to extend across the web of material, the point being located at the center area of the knife.

5. Device according to claim 3 or 4, wherein said cutting apparatus is pivoted on a pivot which is movable into the center of the reel.

6. Device according to claim 5, wherein a pivoting arm supports said pivot, and a deviation means is supported at one end of said pivoting arm, said deviation means being arranged during a pivoting movement of the arm in a direction towards the web of material to deviate the same along said reel.

7. Device according to claim 6, wherein a supporting arm supports said cutting apparatus, said supporting arm being movable relative to said pivoting arm.

8. Device according to claim 7, wherein a deviation element is connected with said supporting arm which is movable into contact with a part of the web of material which is out of contact with said reel and operable to prevent said part of the web of material from coming into contact with the portion of the web of material which runs to the reel.

9. Device according to claim 8, wherein a driving cylinder is provided over which the web of material is led prior to running to said reel, said cylinder being cooperable with the reel and web of material and being rotatable in an area which is located between said reel and said cutting apparatus, and said deviation means and deviation element are connected with said cutting apparatus.

* * * * *